US010206026B2

(12) United States Patent
Yeung et al.

(10) Patent No.: US 10,206,026 B2
(45) Date of Patent: Feb. 12, 2019

(54) PURE WIRELESS HEADPHONE WITH GROUND REFLECTOR

(71) Applicant: Fujikon Industrial Co., Ltd, Shatin (CN)

(72) Inventors: Siu Chung Yeung, Shatin (CN); Man Tai Lam, Shatin (CN)

(73) Assignee: Fujikon Industrial Co., Ltd, Hong Kong (CN)

( * ) Notice: Subject to any disclaimer, the term of this patent is extended or adjusted under 35 U.S.C. 154(b) by 14 days.

(21) Appl. No.: 15/680,178

(22) Filed: Aug. 17, 2017

(65) Prior Publication Data

US 2018/0077484 A1 Mar. 15, 2018

(30) Foreign Application Priority Data

Sep. 13, 2016 (CN) ..... 2016 1 0820151

(51) Int. Cl.

| | |
|---|---|
| ***H04R 1/10*** | (2006.01) |
| ***H01Q 1/27*** | (2006.01) |
| ***H01Q 1/36*** | (2006.01) |
| ***H01Q 1/38*** | (2006.01) |
| ***H01Q 1/48*** | (2006.01) |

(52) U.S. Cl.

CPC ..... *H04R 1/1091* (2013.01); *H01Q 1/273* (2013.01); *H01Q 1/362* (2013.01); *H01Q 1/38* (2013.01); *H01Q 1/48* (2013.01); *H04R 1/1016* (2013.01); *H04R 1/1075* (2013.01); *H04R 2201/109* (2013.01); *H04R 2420/07* (2013.01)

(58) Field of Classification Search

CPC .. H04R 1/1091; H04R 1/1016; H04R 1/1075; H01Q 1/48; H01Q 1/38; H01Q 1/362

USPC ..... 343/718, 788

See application file for complete search history.

(56) References Cited

U.S. PATENT DOCUMENTS

| | | | | |
|---|---|---|---|---|
| 8,229,521 | B2 * | 7/2012 | Kang | H04R 1/1091 455/575.2 |
| 2014/0177863 | A1 * | 6/2014 | Parkins | H04R 1/1091 381/74 |
| 2017/0180844 | A1 * | 6/2017 | Nanni | H04W 76/10 |

* cited by examiner

*Primary Examiner* — Hai V Tran

(74) *Attorney, Agent, or Firm* — Luoh J. Wu; Continent Patent Office LLP

(57) ABSTRACT

The present invention relates to a pure wireless headphone with a ground reflector, pertaining to the field of communication technology, including an in-ear headphone shell and an RF signal generating device arranged in the in-ear headphone shell. The RF signal generating device includes an antenna, a main RF PCB, a battery and a charging PCB, wherein the helical antenna is used, the top tail end of which is connected with a laterally extending metal tail line. The RF signal generating device further includes a metal frame and a metal ground ring. The main RF PCB is arranged at the top of the metal frame, the metal ground ring is located under the helical antenna, and a gap is reserved between a bottom coil of the helical antenna and the top of the metal ground ring. The metal ground ring can change a radiation ground current, and adjust the angle of the radiation direction. The radiation direction of the antenna inclines about 15 degrees. A change in radiation direction ensures more stable transmission and reception of the wireless signal between the earbuds and between the main device and the audio frequency source, such that the wireless connection is more stable and reliable.

10 Claims, 6 Drawing Sheets

PURE WIRELESS HEADPHONE WITH GROUND REFLECTOR

This application claims the benefit of China application number: 201610820151.0 filed on Sep. 13, 2016. The content of this document and the entire disclosure of publications, patents, and patent documents mentioned herein are incorporated by reference.

TECHNICAL FIELD

The present invention relates to the field of communication technology, and in particular, to a pure wireless headphone with a ground reflector.

BACKGROUND

In most common wireless headphones, the communication between the headphone and an audio frequency source (for example, a mobile phone) is maintained by only one radio frequency (RF) receiver. No electric wire is provided between a left earbud and a right earbud of a pair of full wireless headphones, and a stereo effect between a left ear and a right ear may be synchronized by means of a wireless communication channel. In order to realize a full wireless headphone effect, an individual wireless receiver is necessary for each earbud. Most commonly, the full wireless headphone is implemented through two Bluetooth communication lines.

In order to ensure smooth communication between the left earbud and the right earbud, apparently, it is possible to make an antenna away from a human skin as far as possible, to furthest reduce the attenuation caused by a human body. A relatively large antenna may also improve an RF transmission efficiency, and offset the attenuation by the human body. Neither of the two solutions matches a profile of a product with an auricle. The common design method for a full wireless product is to make the headphone not close to the auricles, and place an electronic product in a relatively large product. However, as for a relatively large product, its size goes against an idea of miniaturization, never realizing a product with a light weight and an in-ear-fit application. Another solution for designing the full wireless headphone is an over-ear design where the antenna is placed inside an over-ear headphone. With such a design, the antenna may be easily insulated from the human skin. However, such a structure is too large to be suitable for an in-ear device.

The Chinese invention No. CN105792049A discloses a pure wireless headphone through adoption of an optimum monopole antenna which is configured to build an appropriate RF communication link between an in-ear main receiver and an in-ear auxiliary receiver on head. Meanwhile, the optimum monopole antenna is also able to maintain an appropriate RF communication link between the main receiver and a mobile phone, and is suitable for generating an RF communication link and an RF creeping wave to be coupled with the human skin, so as to ensure the omni-directional radiation of the antenna. However, experiments show that this invention has the following defects that: 1) the monopole antenna cannot ensure the optimum antenna radiation due to a blocking effect by a human face; 2) a connection between a main device and an auxiliary device is not firm; 3) a radiation direction is not parallel with a human face profile, thereby causing a relatively small RF range and relatively poor stability of the wireless connection.

SUMMARY

An object of the present invention is to solve the above defects, and to provide a pure wireless headphone with a ground reflector, which improves an antenna radiation direction and stabilizes the wireless connection.

The present invention is directed to an RF antenna to realize better RF communication between an in-ear main device and an auxiliary device (the head therebetween), to keep a correct connection between the main device and the audio frequency source (for example, the mobile phone), and to stabilize the wireless connection in the case of applying to the wireless headphone.

With a reasonable design, as a key component in a main link between the main receiver and the mobile phone and the link between the main and auxiliary receivers, the antenna may control the transmission and reception of an RF signal.

A large number of studies have shown that an RF wave can be transmitted to different body parts via a skin surface. Based on this, it is concluded that the RF wave can linearly transmit without a medium (such as the human body), and may transmit along a human surface alternatively. Such RF transmission on the human skin surface is referred to as an "RF creeping wave". The RF wave coupled to the human skin and an antenna radiation pattern both affect the ability of generating the RF creeping wave.

Since an RF transmission power is limited by a Bluetooth chipset, such a method of "generating an RF creeping wave with a higher amplitude by enhancing an RF output power" is not desirable. Meanwhile, a higher power may cause a higher power consumption, which is not suitable for a portable device, particularly an in-ear headphone due to its limited battery capacity. Therefore, the shortest communication distance between the "left ear" and the "right ear" is the back of the auricle, based on which, it is optimum to generate the RF creeping wave at the back of the auricle.

In the case that the audio frequency source is too far away from or too close to a user, the wireless headphone usually needs to be stable in terms of communication when placed in different pockets of the user's different trousers. In order to meet this requirement, the antenna shall have a function of omni-directional radiation.

The object of the present invention is realized as following.

A pure wireless headphone with a ground reflector, including an in-ear headphone shell and an RF signal generating device arranged in the in-ear headphone shell, wherein the in-ear headphone shell is formed by pairing and snap-fitting a top shell and a bottom shell, and is provided therein with a hollow cavity; the bottom of the bottom shell extends downwards with a sound outlet conducting with the hollow cavity, is provided therein with a loudspeaker conducting with the sound outlet, and is sheathed by an ear pad for slipping in an external auditory canal; a positioning table paired with the shape of a cavity of auricular concha is arranged at the top of the bottom shell, an outer bottom surface of the positioning table is paired to be attached to a surface of the cavity of auricular concha, an outer wall of the positioning table contacts with a tragus; the RF signal generating device is located in the hollow cavity, including an antenna, a main RF PCB, a battery and a charging PCB, the main RF PCB including a Bluetooth chipset, the antenna is configured to build an RF communication link between an audio frequency source and the antenna of an auxiliary receiver, the battery is electrically connected with the charging PCB, and the charging PCB, the antenna and the loudspeaker are all electrically connected with the main RF PCB.

The main RF PCB is laterally mounted in the hollow cavity. A helical antenna is used, a top tail end of which is connected with a laterally extending metal tail line which extends towards the middle of the hollow cavity. The RF signal generating device further includes a metal frame and a metal ground ring, wherein the metal frame has a hollow vertical tubular structure in which the battery is wrapped. The main RF PCB is arranged at the top of the metal frame, an antenna setting region for mounting the helical antenna is arranged at one end of the main RF PCB, the antenna setting region extends out of the metal frame, the helical antenna is mounted on the antenna setting region and extends upwards, the metal ground ring is located under the helical antenna, a gap is reserved between a bottom coil of the helical antenna and the top of the metal ground ring, and the metal ground ring contacts with the metal frame, such that the metal ground ring is combined with the metal frame to form a ground reflector for adjusting a radiation angle of an RF signal.

In the foregoing description, preferably, this gap is larger than or equal to 3 mm, and less than 6 mm. The ground reflector would affect the helical antenna if too close to an RF feeding point.

In the foregoing description, preferably, a round sphere is drawn with the helical antenna as a center point and an outer wall closest to the helical antenna in the in-ear headphone shell as a radius, and a space formed by the round sphere is an antenna putting region, wherein the helical antenna is located in the antenna putting region and the radius of the round sphere is larger than 4 mm.

When the radius of the round sphere is equal to 4 mm, that is, the distance of the helical antenna from the human skin or tissues is larger than 4 mm, the top of the helical antenna is the optimum antenna feeding point, which meets all the design criteria, and can generate the optimum RF creeping wave and build a stable RF link between the antenna and the audio frequency source (such as a smart phone). In the case that the distance of the helical antenna from the human skin or tissues is larger than 4 mm, an antenna gain and an efficiency attenuation of an in-ear Bluetooth device are in an acceptable range, and the helical antenna is also able to maintain an appropriate RF communication link between the main receiver and the mobile phone.

The auricular concha of the auricle is the only recess in which the in-ear headphone is allowed to be put, and is the optimum part which allows the RF wave to penetrate through the auricle and to generate the RF creeping wave at the back of the ear since it is the thinnest human tissue close to an earhole and the back of the ear.

In the foregoing description, preferably, the metal ground ring has a laterally arranged arc structure, and an outer side of the metal ground ring is located along an inner side of the bottom shell.

In the foregoing description, preferably, the top of the metal frame is provided with four or more welding snap teeth extending upwards. The main RF PCB is provided thereon with welding holes for running through the welding snap teeth in a pairing manner, and is directly welded with the metal frame through the welding snap teeth.

In the foregoing description, preferably, a connector paired with a thickness of the main RF PCB is arranged at the top of the metal frame, an edge of the main RF PCB is homogeneously welded at an edge of the top of the metal frame, the antenna setting region of the main RF PCB extends out of the connector for homogeneously connecting the main RF PCB with the metal frame, so as to obtain better grounding effects.

In the foregoing description, preferably, the metal frame is made of a copper foil material.

In the foregoing description, preferably, the charging PCB is located below the battery.

The present invention has the following beneficial effects as follows.

1) The top tail end of the helical antenna is connected with a laterally extending metal tail line which extends towards the middle of the hollow cavity. The metal tail line is distant from the human skin, so the helical antenna with the metal tail line does not tend to be affected by the human skin absorption, compared with the common helical coil.

2) The RF signal generating device further includes a metal frame which has a hollow vertical tubular structure, the main RF PCB is arranged at the top of the metal frame for increasing a grounding size and radiating and receiving the RF signal more effectively.

3) The RF signal generating device further includes a metal ground ring which is located under the helical antenna, such that the metal ground ring is combined with the metal frame to form a ground reflector. The metal ground ring can change a radiation ground current, and adjust the angle of the radiation direction. With the ground reflector, compared with the antenna without a ground reflector, the radiation direction of the antenna inclines about 15 degrees, such that the RF signal radiation turns to a vertical shaft of the helical coil. In terms of the RF range and the wireless connection stability, the radiation direction decides the performance of the wireless headphone. The radiation direction parallel with the human face profile is an ideal direction for the wireless headphone. Therefore, the ground reflector would further improve the RF radiation and reception and control the wireless performance of the product.

4) Due to a change in radiation direction, the connection between a main audio frequency device (main receiver) and an auxiliary audio frequency device (auxiliary receiver) is more stable, and the antenna radiation is omni-directional, which may ensure more stable transmission and reception of the wireless signal between the earbuds and between the main device and the audio frequency source, such that the wireless connection is more stable and reliable, which owes to the fact that the wireless signal comes from all the directions and is affected by the position of the audio frequency source and the head direction of the user in different situations. The omni-directional antenna may reduce the possibility of a certain angle lower than a certain link budget.

BRIEF DESCRIPTION OF THE DRAWINGS

In FIG. 6, A represents an indication line of the radiation direction of the antenna in the prior art, and B represents an indication line of the radiation direction subsequent to the rotation of the antenna by 15 degrees in the embodiment. In FIGS. 1-6, 1 represents a top shell, 2 represents a bottom shell, 3 represents an ear pad, 4 represents a main RF PCB, 5 represents a helical antenna, 6 represents a metal tail line, 7 represents a metal ground ring, 8 represents a metal frame, 9 represents a charging PCB, 10 represents a battery, 11 represents a loudspeaker, 12 represents welding snap teeth, 13 represents a human head, and 14 represents an RF communication link.

DETAILED DESCRIPTION

The present invention will further be described in detail in combination with the drawings and the embodiments.

In the present embodiments, referring to FIGS. 1-6, the embodied pure wireless headphone with a ground reflector includes an in-ear headphone shell and an RF signal generating device arranged in the in-ear headphone shell, wherein the in-ear headphone shell is formed by pairing and snap-fitting a top shell 1 and a bottom shell 2, and is provided therein with a hollow cavity; the bottom of the bottom shell 2 extends downwards with a sound outlet conducting with the hollow cavity, is provided therein with a loudspeaker 11 conducting with the sound outlet, and is sheathed by an ear pad 3 for slipping in an external auditory canal; a positioning table paired with the shape of a cavity of auricular concha is arranged at the top of the bottom shell 2, an outer bottom surface of the positioning table is paired to be attached to a surface of the cavity of auricular concha, an outer wall of the positioning table contacts with a tragus.

Figure 1:
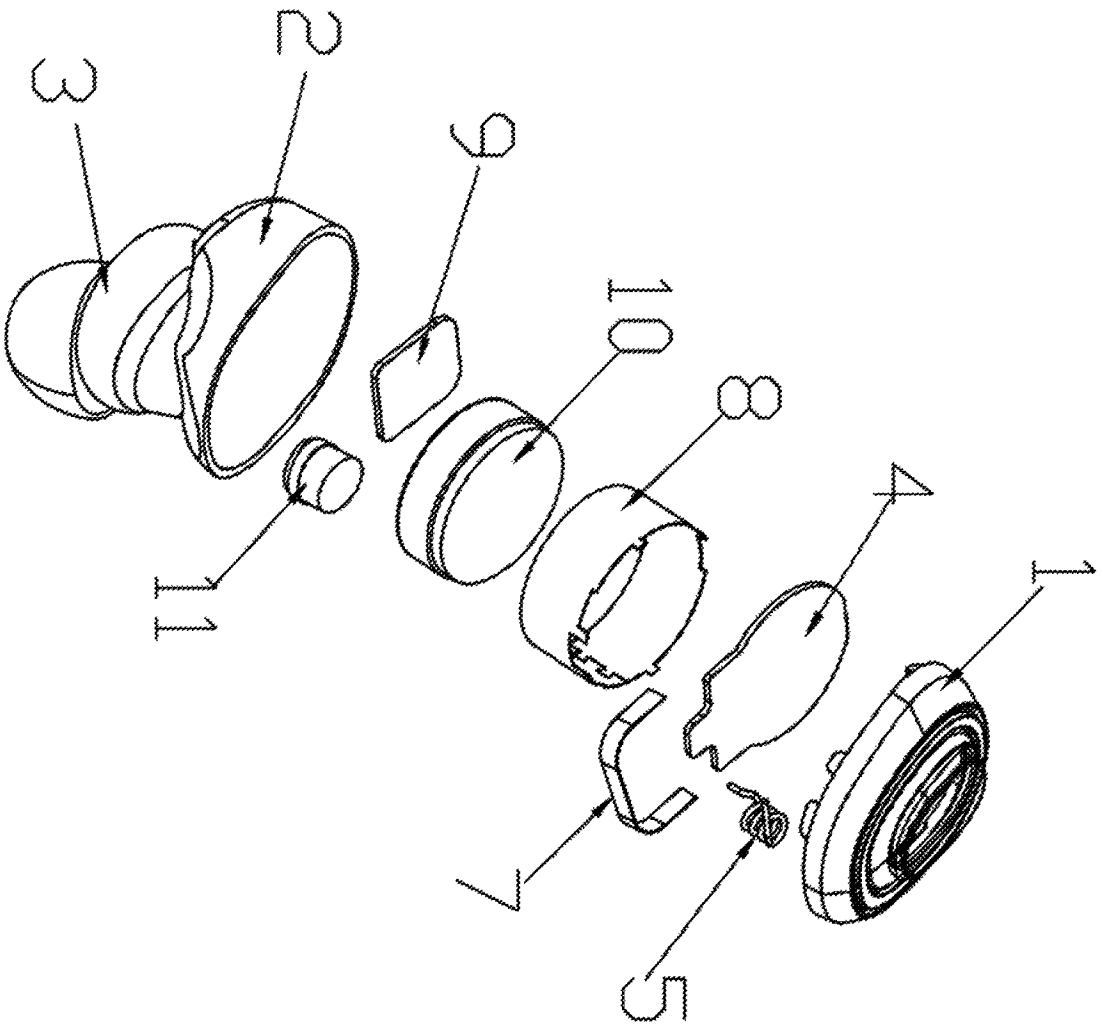
FIG. 1 is a structural exploded schematic diagram of an embodiment according to the present invention.
Figure 2:
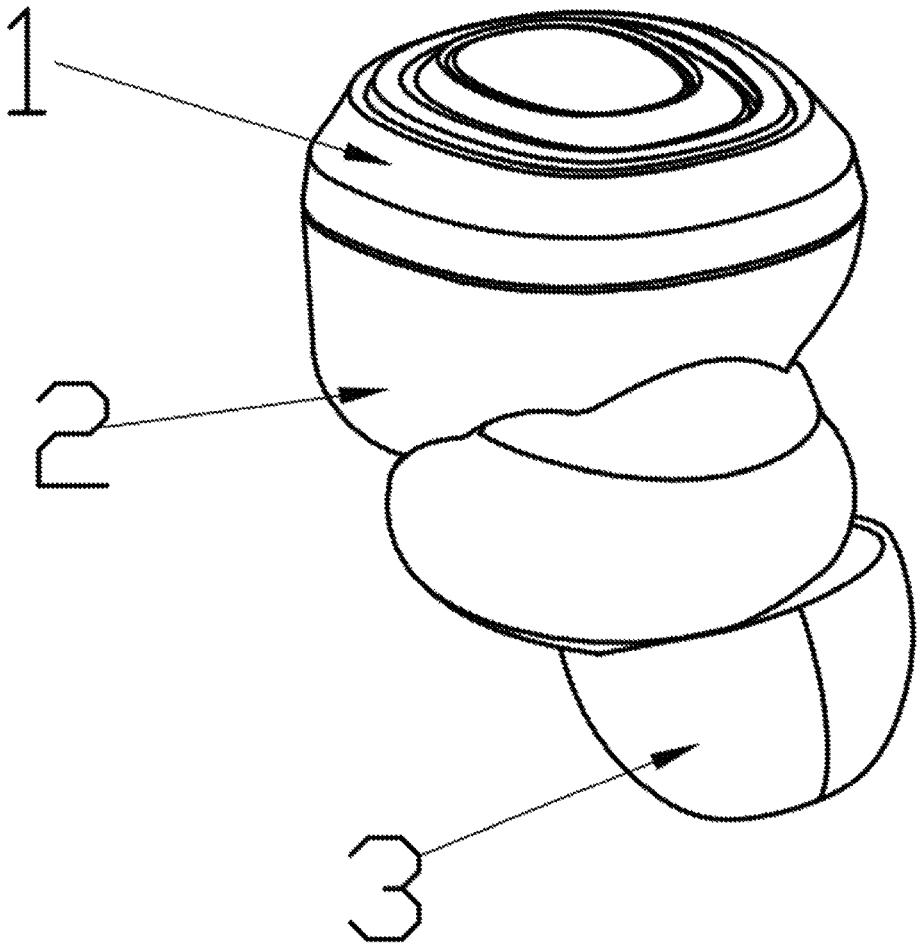
FIG. 2 is a schematic diagram showing a combination state of an embodiment according to the present invention.
Figure 3:
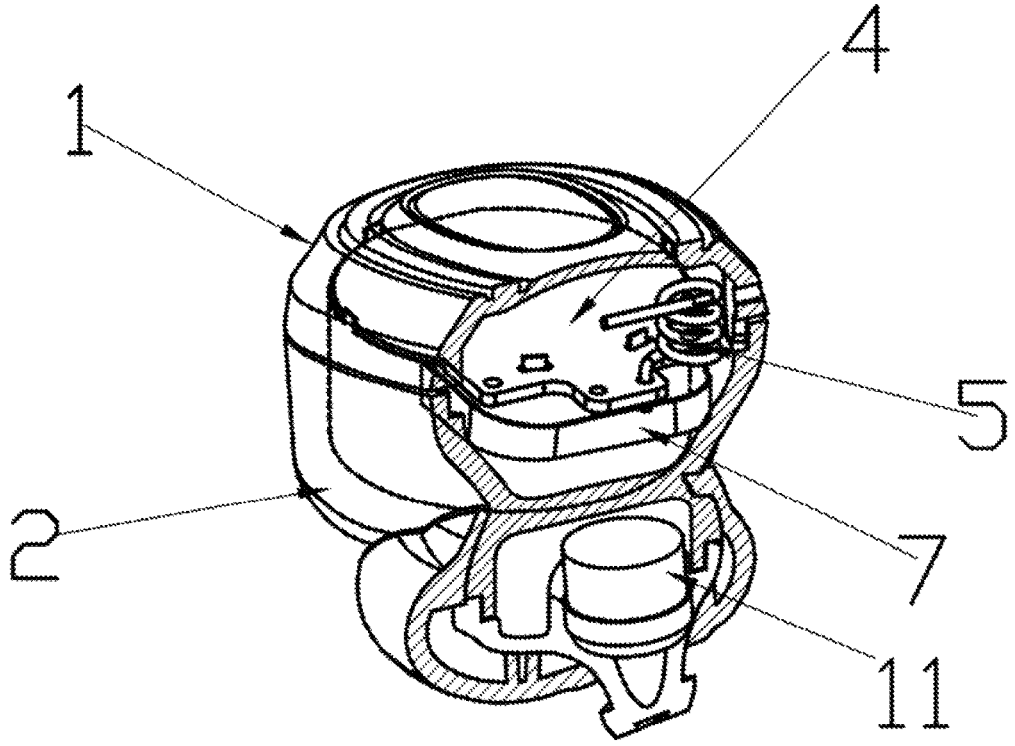
FIG. 3 is a sectional view of an embodiment according to the present invention.
Figure 4:
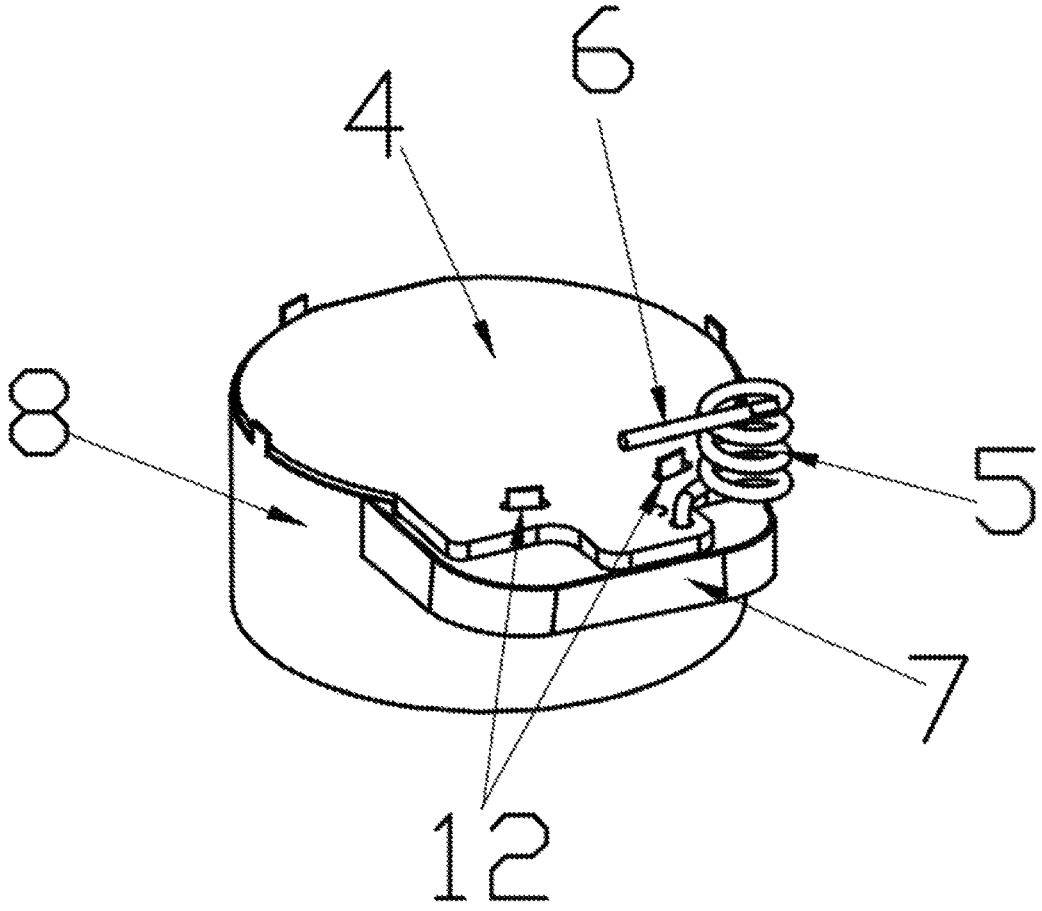
FIG. 4 is a perspective structural schematic diagram of an RF signal generating device in the embodiment according to the present invention.

As shown in FIGS. 1, 3 and 4, the RF signal generating device is located in the hollow cavity, including an antenna, a main RF PCB 4, a battery 10 and a charging PCB 9, the charging PCB 9 is located below the battery 10, the main RF PCB 4 including a Bluetooth chipset, the antenna is configured to build an RF communication link 14 between an audio frequency source and the antenna of an auxiliary receiver, the battery 10 is electrically connected with the charging PCB 9, and the charging PCB 9, the antenna and the loudspeaker 11 are all electrically connected with the main RF PCB 4.

As shown in FIGS. 1, 3 and 4, the main RF PCB 4 is laterally mounted in the hollow cavity. A helical antenna 5 is used, a top tail end of which is connected with a laterally extending metal tail line 6 which extends towards the middle of the hollow cavity. The RF signal generating device further includes a metal frame 8 and a metal ground ring 7, wherein the metal frame 8 has a hollow vertical tubular structure in which the battery 10 is wrapped. The main RF PCB 4 is arranged at the top of the metal frame 8, an antenna setting region for mounting the helical antenna 5 is arranged at one end of the main RF PCB 4, the antenna setting region extends out of the metal frame 8, the helical antenna 5 is mounted on the antenna setting region and extends upwards, the metal ground ring 7 is located under the helical antenna 5, a gap is reserved between a bottom coil of the helical antenna 5 and the top of the metal ground ring 7, and the metal ground ring 7 contacts with the metal frame 8. In the present embodiment, it is optimum that this gap is larger than 3 mm and less than 6 mm. The ground reflector would affect the helical antenna 5 if too close to an RF feeding point. The metal ground ring 7 has a laterally arranged arc structure, and an outer side of the metal ground ring 7 is located along an inner side of the bottom shell 2. Such an arc structure may maximize the size of the metal ground ring 7. The metal ground ring 7 is combined with the metal frame 8 to form a ground reflector for adjusting a radiation angle of an RF signal. The metal frame 8 is configured to increase a grounding size and radiate and receive the RF signal more effectively.

The top tail end of the helical antenna 5 is connected with a laterally extending metal tail line 6 which extends towards the middle of the hollow cavity. The metal tail line 6 is distant from the human skin, so the helical antenna 5 with the metal tail line 6 does not tend to be affected by the human skin absorption, compared with the common helical coil.

Figure 6:
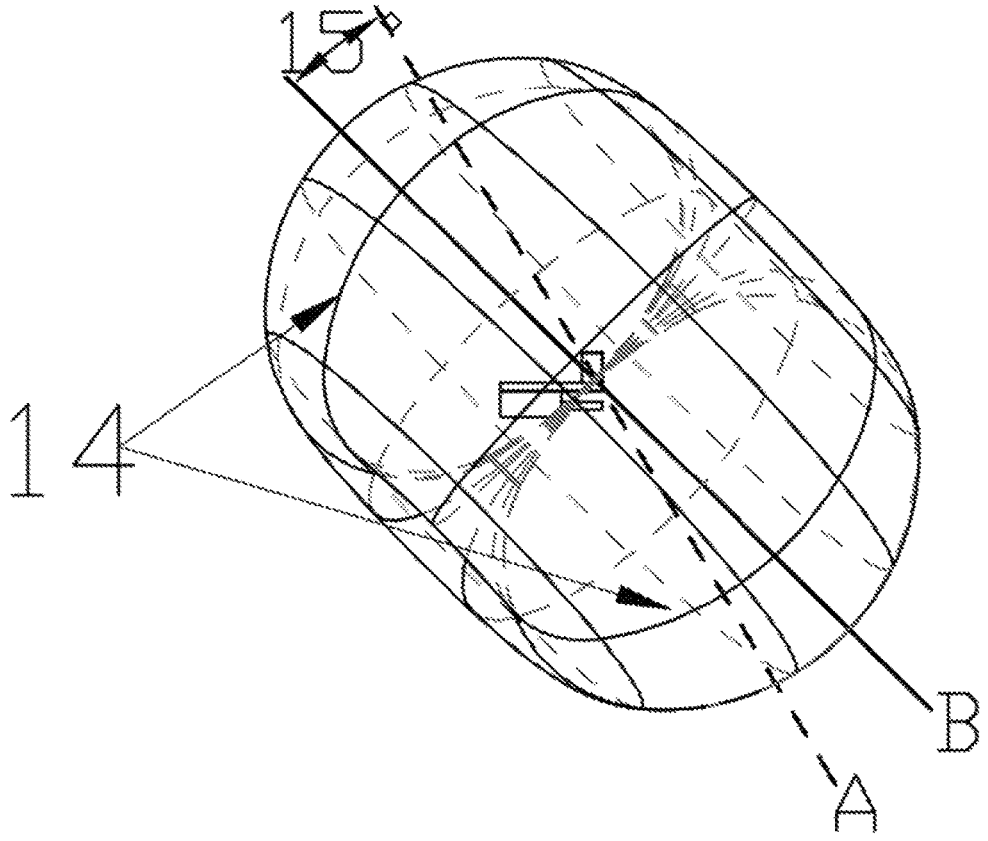
FIG. 6 is a schematic diagram showing the direction adjustment of 3D antenna radiation in the embodiment according to the present invention.

The RF signal generating device further includes a metal ground ring 7 which is located under the helical antenna 5, such that the metal ground ring 7 is combined with the metal frame 8 to form a ground reflector. The metal ground ring 7 can change a radiation ground current, and adjust the angle of the radiation direction. With the ground reflector, compared with the antenna without a ground reflector, as shown in FIG. 6, the radiation direction of the antenna inclines about 15 degrees, such that the RF signal radiation turns to a vertical shaft of the helical coil. In terms of the RF range and the wireless connection stability, the radiation direction decides the performance of the wireless headphone. The radiation direction parallel with the human face profile is an ideal direction for the wireless headphone. Therefore, the ground reflector would further improve the RF radiation and reception and control the wireless performance of the product.

In the present embodiment, a round sphere is drawn with the helical antenna 5 as a center point and an outer wall closest to the helical antenna 5 in the in-ear headphone shell as a radius, and a space formed by the round sphere is an antenna putting region, wherein the helical antenna 5 is located in the antenna putting region and the radius of the round sphere is larger than 4 mm. In the case that the distance of the helical antenna 5 from the human skin or tissues is larger than 4 mm, an antenna gain and an efficiency attenuation of an in-ear Bluetooth device are in an acceptable range, and the helical antenna 5 is also able to maintain an appropriate RF communication link 14 between the main receiver and the mobile phone.

Figure 5:
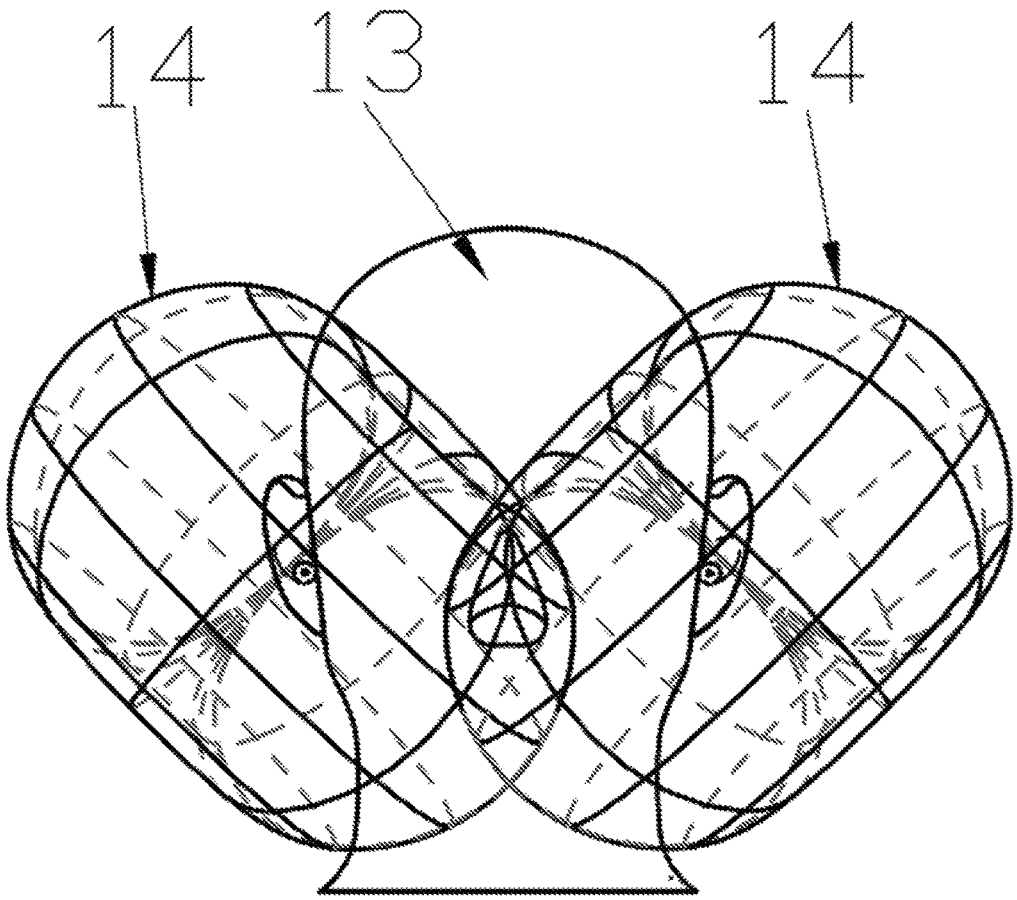
FIG. 5 is a fundamental diagram of 3D antenna radiation in the embodiment according to the present invention.

FIG. 5 shows how an EM wave radiates, how the EM wave penetrates through the auricle of the human head 13 and couples with the human skin at the back of the auricle, and how the RF communication link 14 is formed between the left and right ears.

As shown in FIGS. 3 and 4, the top of the metal frame 8 is provided with five welding snap teeth 12 extending upwards. The main RF PCB 4 is provided thereon with welding holes for running through the welding snap teeth 12 in a pairing manner, and is directly welded with the metal frame through the welding snap teeth 12. A connector paired with a thickness of the main RF PCB 4 is arranged at the top of the metal frame 8, an edge of the main RF PCB 4 is homogeneously welded at an edge of the top of the metal frame 8, the antenna setting region of the main RF PCB 4 extends out of the connector for homogeneously connecting the main RF PCB 4 with the metal frame 8, so as to obtain better grounding effects and radiate and receive the RF signal more effectively.

The present invention is described in detail in accordance with the above contents with the specific preferred examples. However, this invention is not limited to the specific examples. For the ordinary technical personnel of the technical field of the present invention, on the premise of keeping the conception of the present invention, the technical personnel can also make simple deductions or replacements, and all of which should be considered to belong to the protection scope of the present invention.

What is claimed is:

1. A pure wireless headphone with a ground reflector, comprising an in-ear headphone shell and an RF signal generating device arranged in the in-ear headphone shell, wherein the in-ear headphone shell is formed by pairing and snap-fitting a top shell and a bottom shell, and is provided therein with a hollow cavity; the bottom of the bottom shell extends downwards with a sound outlet conducting with the hollow cavity, is provided therein with a loudspeaker conducting with the sound outlet, and is sheathed by an ear pad for slipping in an external auditory canal; a positioning table paired with the shape of a cavity of auricular concha is arranged at the top of the bottom shell, an outer bottom surface of the positioning table is paired to be attached to a surface of the cavity of auricular concha, an outer wall of the positioning table contacts with a tragus; the RF signal generating device is located in the hollow cavity, comprising an antenna, a main RF PCB, a battery and a charging PCB, the main RF PCB comprising a Bluetooth chipset, the antenna is configured to build an RF communication link between an audio frequency source and the antenna of an auxiliary receiver, the battery is electrically connected with the charging PCB, and the charging PCB, the antenna and the loudspeaker are all electrically connected with the main RF PCB, wherein the main RF PCB is laterally mounted in the hollow cavity; a helical antenna is used, a top tail end of which is connected with a laterally extending metal tail line which extends towards the middle of the hollow cavity; the RF signal generating device further comprises a metal frame and a metal ground ring, wherein the metal frame has a hollow vertical tubular structure in which the battery is wrapped; the main RF PCB is arranged at the top of the metal frame, an antenna setting region for mounting the helical antenna is arranged at one end of the main RF PCB, the antenna setting region extends out of the metal frame, the helical antenna is mounted on the antenna setting region and extends upwards, the metal ground ring is located under the helical antenna, a gap is reserved between a bottom coil of the helical antenna and the top of the metal ground ring, and the metal ground ring contacts with the metal frame, such that the metal ground ring is combined with the metal frame to form a ground reflector for adjusting a radiation angle of an RF signal.

2. The pure wireless headphone with a ground reflector according to claim 1, wherein this gap is larger than or equal to 3 mm, and less than 6 mm.

3. The pure wireless headphone with a ground reflector according to claim 1, wherein a round sphere is drawn with the helical antenna as a center point and an outer wall closest to the helical antenna in the in-ear headphone shell as a radius, and a space formed by the round sphere is an antenna putting region, wherein the helical antenna is located in the antenna putting region and the radius of the round sphere is larger than 4 mm.

4. The pure wireless headphone with a ground reflector according to claim 3, wherein the metal ground ring has a laterally arranged arc structure, and an outer side of the metal ground ring is located along an inner side of the bottom shell.

5. The pure wireless headphone with a ground reflector according to claim 4, wherein the top of the metal frame is provided with four or more welding snap teeth extending upwards. The main RF PCB is provided thereon with welding holes for running through the welding snap teeth in a pairing manner, and is directly welded with the metal frame through the welding snap teeth.

6. The pure wireless headphone with a ground reflector according to claim 5, wherein a connector paired with a thickness of the main RF PCB is arranged at the top of the metal frame, an edge of the main RF PCB is homogeneously welded at an edge of the top of the metal frame, the antenna setting region of the main RF PCB extends out of the connector.

7. The pure wireless headphone with a ground reflector according to claim 6, wherein the metal frame is made of a copper foil material.

8. The pure wireless headphone with a ground reflector according to claim 6, wherein the charging PCB is located below the battery.

9. The pure wireless headphone with a ground reflector according to claim 1, wherein the top of the metal frame is provided with four or more welding snap teeth extending upwards. The main RF PCB is provided thereon with welding holes for running through the welding snap teeth in a pairing manner, and is directly welded with the metal frame through the welding snap teeth.

10. The pure wireless headphone with a ground reflector according to claim 9, wherein a connector paired with a thickness of the main RF PCB is arranged at the top of the metal frame, an edge of the main RF PCB is homogeneously welded at an edge of the top of the metal frame, the antenna setting region of the main RF PCB extends out of the connector.

* * * * *